US012110883B2

(12) United States Patent
Verrelst et al.

(10) Patent No.: US 12,110,883 B2
(45) Date of Patent: Oct. 8, 2024

(54) PISTON COMPRESSOR

(71) Applicants: ATLAS COPCO AIRPOWER, NAAMLOZE VENNOOTSCHAP, WILRIJK (BE); VRIJE UNIVERSITEIT BRUSSEL, Brussels (BE)

(72) Inventors: Bjorn Verrelst, Wilrijk (BE); Jarl Beckers, Brussels (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 241 days.

(21) Appl. No.: 17/297,773

(22) PCT Filed: Dec. 3, 2019

(86) PCT No.: PCT/IB2019/060401
§ 371 (c)(1),
(2) Date: May 27, 2021

(87) PCT Pub. No.: WO2020/128698
PCT Pub. Date: Jun. 25, 2020

(65) Prior Publication Data

US 2021/0372384 A1 Dec. 2, 2021

(30) Foreign Application Priority Data

Dec. 18, 2018 (BE) ..... 2018/5894

(51) Int. Cl.
*F04B 39/00* (2006.01)
*F04B 17/04* (2006.01)
(Continued)

(52) U.S. Cl.
CPC ..... *F04B 39/0094* (2013.01); *F04B 17/044* (2013.01); *F04B 25/005* (2013.01);
(Continued)

(58) Field of Classification Search
CPC ..... F04B 17/04; F04B 17/044; F04B 35/045; F04B 39/0094; F04B 19/22; F04B 49/20
See application file for complete search history.

(56) References Cited

U.S. PATENT DOCUMENTS 6,684,941 B1 * 2/2004 Cao ..... F28D 15/0266 165/104.25
2006/0127252 A1 6/2006 Caddell
(Continued)

FOREIGN PATENT DOCUMENTS

DE 4129018 A1 3/1993
DE 102006060147 A1 6/2008
(Continued)

OTHER PUBLICATIONS

JP46012998Y translation (Year: 2023).*
(Continued)

*Primary Examiner* — Charles G Freay
*Assistant Examiner* — David N Brandt
(74) *Attorney, Agent, or Firm* — BACON & THOMAS, PLLC

(57) ABSTRACT

A piston compressor containing a housing with a compression chamber in it, having an inlet and an outlet and a piston arranged movably back and forth in an axial direction in the compression chamber between an upper dead point and a lower dead point, delimited by a kinematic mechanism with which the piston is connected. The drive is formed exclusively by an electromagnetic linear drive of the piston.

16 Claims, 4 Drawing Sheets

(51) Int. Cl.

| | |
|---|---|
| ***F04B 19/22*** | (2006.01) |
| ***F04B 25/00*** | (2006.01) |
| ***F04B 35/04*** | (2006.01) |
| ***F04B 41/06*** | (2006.01) |
| ***F04B 49/20*** | (2006.01) |

(52) U.S. Cl.

CPC ..... *F04B 35/045* (2013.01); *F04B 41/06* (2013.01); *F04B 19/22* (2013.01); *F04B 49/20* (2013.01)

(56) References Cited

U.S. PATENT DOCUMENTS

| | | | | |
|---|---|---|---|---|
| 2012/0098357 | A1* | 4/2012 | Hunstable | H02K 7/075 310/20 |
| 2012/0192710 | A1* | 8/2012 | Moore | F04B 39/121 92/12.2 |
| 2017/0284386 | A1* | 10/2017 | Nakaniwa | H01J 37/32935 |
| 2017/0298916 | A1 | 10/2017 | Teylor | |

FOREIGN PATENT DOCUMENTS

| | | | | |
|---|---|---|---|---|
| EP | 0566959 | * | 10/1993 | F04B 35/04 |
| EP | 0566959 | A1 | 10/1993 | |
| JP | 46012998 | Y * | 5/1971 | |
| JP | H05302571 | A | 11/1993 | |
| JP | 2002005495 | A | 1/2002 | |
| JP | 4612998 | B2 | 1/2011 | |
| JP | 4764644 | B2 | 9/2011 | |
| JP | 4925005 | B2 | 4/2012 | |
| JP | 5302571 | B2 | 10/2013 | |
| WO | 2009120670 | A1 | 10/2009 | |

OTHER PUBLICATIONS

KR Office Action in corresponding KR Application No. 10-2021-7021629, dated Jan. 30, 2023.

International Search Report and Written Opinion in corresponding PCT Application No. PCT/IB2019/060401, dated Feb. 5, 2020.

International Preliminary Report on Patentability in corresponding PCT Application No. PCT/IB2019/060401, dated Dec. 9, 2020.

* cited by examiner

PRIOR ART

PISTON COMPRESSOR

The present invention relates to a piston compressor.

BACKGROUND OF THE INVENTION

More specifically, but without limitations, the invention relates to a high capacity piston compressor, for instance with a capacity of more than 30 kW to 600 kW or higher.

Such piston compressors are used, for instance, for the compression of gases at a very high operating pressure, for instance of 2000 kPa or more.

Traditionally, a piston compressor contains a piston compressor element that features a housing with a compression chamber in which a piston is arranged movably back and forth in an axial direction between an upper dead point and a lower dead point by means of drive shaft driven by a rotary motor, and in which a kinematic mechanism is provided between this drive shaft and the piston in the form of a crank and rod mechanism, and possibly also an extra piston rod that moves linearly with the piston and forms a link between the piston and the crank and rod mechanism.

For the realization of such high gas pressures, usually, a multistage piston compressor is used with two or more of the aforementioned piston compressor elements that are serially connected with each other via their gas inlets and their gas outlets, and which are mounted on a joint drive group in the form of a housing in which a joint drive shaft is supported, with a crank and rod mechanism connected to each piston compressor element and possibly a piston rod for linking the pistons with the crank and rod mechanism.

The drive group features a rotary motor, typically an electrical motor, for driving the joint drive shaft, in most cases via a belt drive. Such a belt drive has the advantage of being relatively inexpensive, but it also has the disadvantage of being responsible for a relatively large loss of power, up to 3 to 5% of the nominal capacity of the motor.

It goes without saying that the drive group must be designed to handle the full capacity of the motor, and therefore also its full compression capacity, and it is therefore relatively heavy and bulky in case of a piston compressor with a high capacity.

In view of the high mechanical forces acting in the crank and rod mechanism, typically, oil film bearings are used, which may be responsible for a loss of power of between 5% and 10%, and which furthermore require a complex injection system in order to provide the bearings with sufficient oil in all circumstances.

In order to prevent the compressed gas from leaking into the housing of the drive group and escaping via the drive shaft, specially designed axial seals are used, by means of which the housing can never be entirely hermetically sealed.

Also previously known is an application of a piston compressor, in which a piston is moved back and forth by electromagnetic activation in order to compress a gas in the compression chamber. This application is limited to low capacities, however. Academic research of higher capacities has led to extremely heavy and bulky compressors with, for instance, a piston of 400 kg for a capacity of 30 kW.

Moreover, this application requires a more complicated motion control with wide safety margins in order to avoid a collision between the head of the piston and the end wall of the compression chamber at the end of the compression stroke. Taking into account this wide safety margin, when reaching the upper dead point, there must always be enough play between the piston and the end wall of the compression chamber, which results in a smaller field of application of the piston compressor, because it also allows for building up a smaller pressure than would be theoretically possible with a smaller safety margin, and also results in a lower volumetric gain.

SUMMARY OF THE INVENTION

The task of the present invention is to offer a solution to one or more of the aforementioned and other disadvantages.

For these purposes, the invention relates to a piston compressor containing a housing with a compression chamber in it, having an inlet and an outlet and a piston arranged movably back and forth in an axial direction in the compression chamber between an upper dead point and a lower dead point by means of a drive, delimited by a kinematic mechanism with which the piston is connected, in which the drive is formed exclusively by an electromagnetic linear drive of the piston.

Because the piston or pistons are no longer driven via a crank and rod mechanism, as is customary, a rotary drive motor is no longer necessary, and the drive group with the crank and rod mechanism can be executed in a much more compact, light, and less expensive manner.

Furthermore, such a piston compressor according to the invention is much more efficient, due to the elimination of the losses in the motor and the belt drive, and because the customary "fluid bearings" can be replaced by more traditional bearings with a lower loss, which furthermore do not require lubrication, as opposed to closed grease-lubricated bearings such as grease-lubricated roller bearings, i.e. bearings with rolling elements that are enclosed in a space between an inner ring and an outer that is filled with grease, but "smaller" fluid bearings continue to be possible as well.

Maintaining the kinematic mechanism ensures that there is no risk of the piston colliding with the end wall of the compression chamber at its upper dead point at the end of the compression stroke, so that a very small safety margin can be used, allowing the piston to approach this end wall very closely, with a minimal headroom between the two. This is useful, because the smaller the headroom, the larger the mounted pressure of the gas in the compression chamber, and therefore the greater the field of application of the compressors.

As a result, a piston compressor according to the invention also does not require complex controls for maintaining a minimal headroom.

Any small deviations at the end of the compression stroke are absorbed by the kinematic mechanism, which does not allow the piston to move beyond its upper dead point.

Preferably, the piston is driven at a frequency approximately corresponding with that of the piston compressor's own frequency, specifically with the own frequency of the entirety of the piston and the kinematic mechanism combined with a pneumatic, mechanical, or electromechanical spring. This allows for an energetically more efficient manner of compressing a gas.

The kinematic mechanism preferably contains a simple traditional crank and rod mechanism with a crank that is rotatable around a crank shaft perpendicular to the direction of the linear movement of the piston, as well as a driving rod with a hinged connection at one end with the crank by means of a crank pin and a hinged connection at its other end with the piston by means of a piston pin, wherein the crank shaft, the crank pin, and the piston pin are preferably borne by closed grease-lubricated bearings.

Since the housing of the piston compressor has no input or output shaft for driving the piston, and since no external lubrication of the bearings is needed, the housing may be completely hermetically sealed, with the obvious exception of the gas inlet and the gas outlet to and from the compression chamber.

The electromagnetic drive may comprise a direct electromagnetic drive, having a direct electromagnetic impact on the piston via one or several electrical coils around the compression chamber.

Furthermore or in the alternative, the electromagnetic drive may comprise an indirect electromagnetic drive of the piston, with a plunger that is connected with the piston and moves synchronously back and forth with it in a linear guide or housing that extends parallel to the axial direction of the compression chamber, and with one or several coils arranged around the linear guide that are capable of interacting inductively with the respective plunger.

The invention also relates to a multistage piston compressor with at least two compression chambers serially connected with each other by means of their inlet and outlet, and in which a piston can be moved back and forth by means of a linear electromagnetic drive, and every piston is connected with a kinematic mechanism of its own.

Possibly, in this case, at least two of the kinematic mechanisms are mechanically connected with each other, such that they move synchronously. In the case of a crank and rod mechanism, the cranks of these at least two mechanisms are mounted on a joint crank shaft.

BRIEF DESCRIPTION OF THE DRAWINGS

In order to better demonstrate the features of the present invention, some examples are described hereinafter, in an exemplary manner and without any restrictive character, of a piston compressor according to the invention, with reference to the accompanying figures, wherein FIG. 1 schematically shows a customary piston compressor.

DETAILED DESCRIPTION OF THE INVENTION

Figure 1:
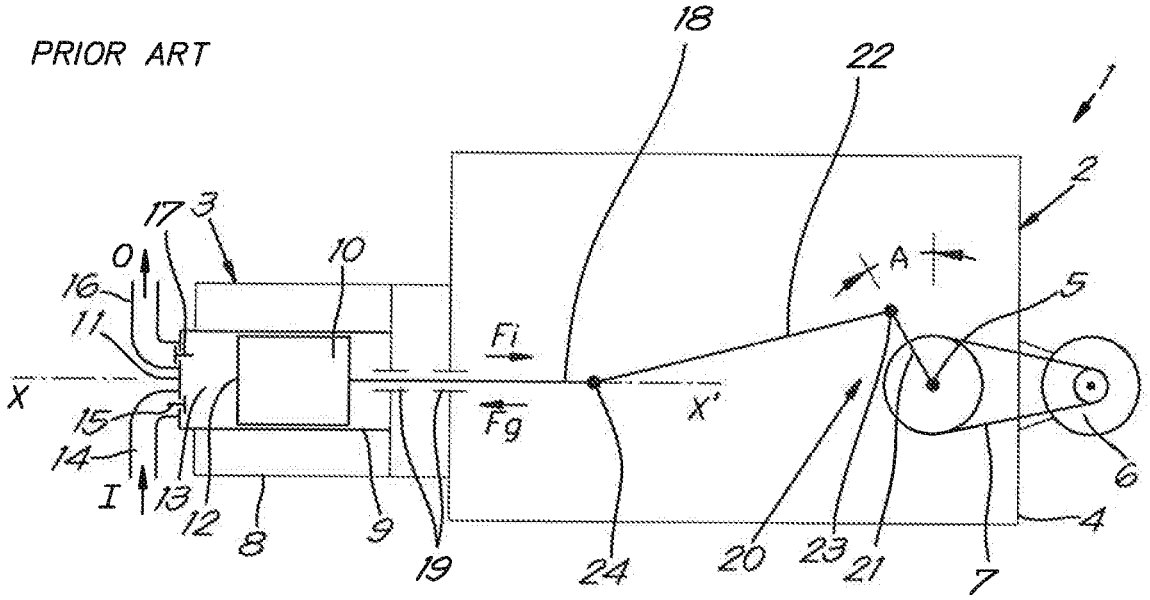
Fig. 1 PRIOR ART

The prior art piston compressor 1 shown in FIG. 1 contains a drive group 2 and a piston compressor element 3 mounted on it.

The drive group 2 contains a housing 4, in which a drive shaft 5 is rotatably supported and is driven by means of an electrical rotary motor 6 via a belt transmission 7.

The piston compressor element 3 features a housing 8 mounted on the housing 4 of the drive group 2, featuring a cylinder mantle 9 in which a piston 10 is arranged movably back and forth in an axial direction X-X', and which is closed off on one side by an end wall 11.

Between the piston crown 12, the aforementioned end wall 11, and the cylinder mantle 9 of the piston compressor element 3, a compression chamber 13 is enclosed, connected in a common manner via a sealable inlet 14 with an inlet valve 15 and via a sealable outlet 16 with an outlet valve 17 with the surroundings for suctioning in a gas for compression as indicated by arrow I, and for expressing the gas at the end of a compression stroke in the direction of arrow O.

During the compression stroke, the piston 10 moves from a so-called lower dead point farthest from the end wall 11 in the direction of the end wall 11 to a so-called upper dead point closest to the end wall 11, and does so with closed inlet and outlet valves 15 and 17.

In the upper dead point, the volume of the compression chamber 13, the so-called dead volume, is smallest, and the pressure of the gas in the compression chamber 13 at that moment is strong.

Connected to the piston 10 is a piston rod 18, extending in the axial direction X-X' and capable of moving back and forth synchronously with the piston 10 in a sealing guide 19 of the housing that forms a gas seal between the housing 8 of the piston compressor element 3 and the housing 4 of the drive group 2 in order to prevent the compressed gas from leaking out via the housing 4 of the drive group 2 and the passage of the drive shaft.

Between the piston rod 18 and the drive shaft 5, a kinematic mechanism 20 is provided for the transformation of the rotary movement of the drive shaft 5 into a back and forth movement of the piston 10.

In the case of FIG. 1, this is a crank and rod mechanism with a radially focused crank 21 that rotates with the drive shaft 5 and a driving rod 22 that is pivotally attached on one end with the crank 21 by means of a crank pin 23, and on the other end with the piston 10 or the piston rod 18 by means of a piston pin 24.

The operations of the piston compressor according to prior art are simple, as follows.

The drive shaft 5 is driven by the motor 6 in one direction, such that the crank 21 is brought into a rotary movement and the piston 10 is moved back and forth.

With any suctioning stroke from the upper dead point to the lower dead point, gas is suctioned into the compression chamber 13 via the inlet 14, whereas with any movement in the opposite direction from the lower dead point to the upper dead point, the suctioned gas is compressed as the inlet valve 15 and the outlet valve 17 are closed.

Figure 2:
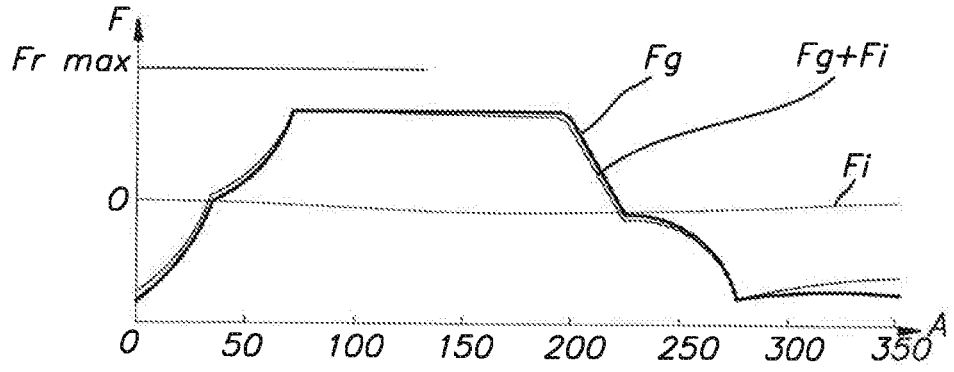
FIG. 2 shows a graph of the forces operating when the piston compressor of FIG. 1 is in use.

During operation, the piston rod 18 and the piston pin 24 are subject to gas forces Fg and to sinusoidal inertia forces Fi with their harmonics as shown in FIG. 1, of which the momentary value is shown in the graph of FIG. 2 as a function of the pivoting angle A of the crank 21. The gas force Fg is obviously proportional to the required operating pressure of the piston compressor 1.

In this graph, the resulting force Fg+Fi acting on the piston rod 18 and on the piston pin 24, which is the sum of the forces Fg and Fi, is shown as well. During the compression stroke of the piston 10, this is a compression force by which the piston rod 18 is compressed.

Constructively, this resulting force may not be higher than a certain maximum value Frmax, which is primarily determined by the compressive strength of the piston rod 18 and/or the strength of the piston pin 24, and which is often the limiting factor for the design, or the choice, of a piston compressor as a function of the desired operating pressure, and a drive group must be chosen with a piston rod and a piston pin that are sufficiently strong for handling the desired gas pressure.

Figure 3:
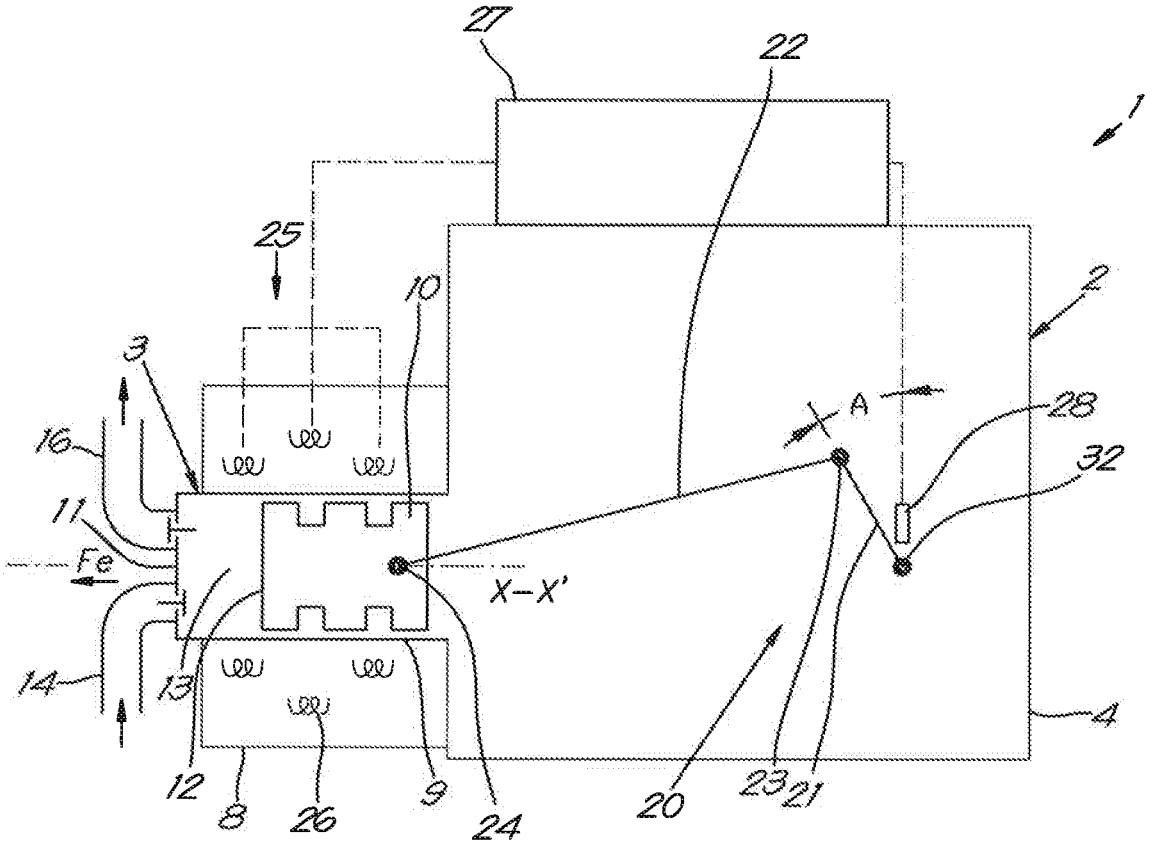
FIG. 3 is a schematic representation of a piston compressor according to the invention.

As schematically shown in FIG. 3, the piston compressor 1 according to the invention differs from the traditional piston compressor 1 of FIG. 1 in that in the case of the invention, no motor 6 is present for driving the piston 10 via the kinematic mechanism 20, and instead, the drive of the piston 10 is formed exclusively by an electromagnetic linear drive 25 of the piston 10.

In this case, the piston is also connected directly, meaning: without interventions of a piston rod, with the kinematic mechanism 20.

The electromagnetic linear drive 25 is formed by one or more electrical coils 26 arranged around or along the cylinder chamber 13, and which directly and inductively exerts an axial force Fe on the piston 10 when reinforced by a control 27, which is executed for that purpose in a suitable magnetic conducting material, or may, for instance, have one or more permanent magnets, not shown here.

In the case of FIG. 3, three coils 26 are provided, which can be reinforced separately or jointly in order to apply a certain force curve to the piston 10 in order to move it back and forth in an appropriate manner, including the gas that is to be compressed in the compression chamber 13.

For these purposes, the piston compressor 1 features means 28 for identifying the current position of the piston 10, for instance in the form of means for measuring the angle A of the crank 21 at a given moment, which means are connected with the controls 27.

Figure 4:
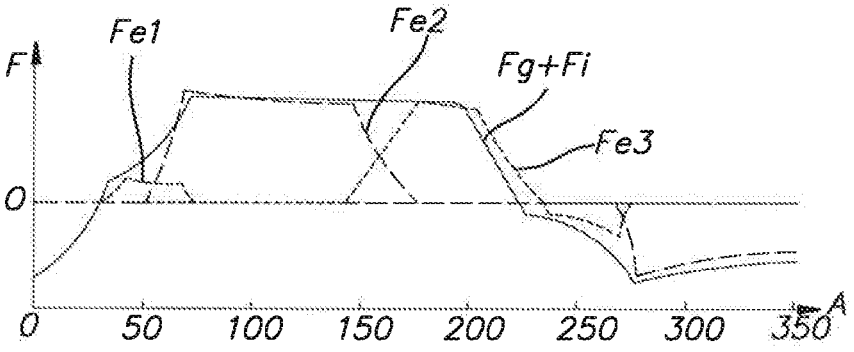
FIG. 4 shows a graph of the forces operating on the piston of the piston compressor of FIG. 3, together with the forces of the graph of FIG. 2, for comparison purposes.

As a function of the measured angle A, each of the coils 26 is reinforced separately in order to subject the piston 10 during a revolution of the crank 21 to three electromagnetic forces Fe1, Fe2, and Fe3, as shown in the graph of FIG. 4, in which the force curves of these three forces Fe1, Fe2, and Fe3 may overlap with each other in time in order to optimally approach the forces graph Fg+Fi of FIG. 2 in order to generate a resulting force that ensures that at the upper and lower dead point, the direction of the resulting force is reversed.

The control program of the controls 27 does not necessarily have to be very accurate, since the kinematic mechanism 20 imposes a limit on the back and forth movements of the piston 10 between the lower and the upper dead point, such that there is no risk that the piston 10 would collide with the end wall 11 at the end of the compression stroke, even in case of a small deviation from the resulting force curve that would prevent the direction of the resulting force from changing when the upper or lower dead point is reached.

There is therefore no need for the design of the controls to take into account a wide safety margin, as a result of which the dead volume between the piston 10 and the end wall 11 of the compression chamber 13 can be reduced to a minimum, allowing for the realization of higher pressures.

The frequency of the back and forth movement of the piston preferably corresponds with the own frequency of the piston compressor, specifically with the entirely of the piston 10 and the kinematic mechanism 20 combined with a pneumatic, mechanical, or electromechanical spring, for instance formed by the compressed air in the compression chamber 13, as a result of which an energy-efficient compression can be realized.

Since in the case of the invention, a motor 6 and a belt transmission 7 are missing, the kinematic mechanism 20 does not have to transmit forces for driving the piston 10, and as a result, this kinematic mechanism 20 can be designed in a much lighter and less sturdy manner, and the requirements for the bearings and the lubrication of this kinematic mechanism 20 can be much lower.

For the same reason, the internal space that is delimited by the housings 4 and 8 can be hermetically closed by the piston.

It is clear that the piston 10 can be connected with the kinematic mechanism 20 by means of a piston rod 18 connected with the piston 10. Since the piston is not driven by this piston rod 18, the forces exerted on it are therefore much lower than in the case of a traditional piston compressor driven by a rotary motor.

Figure 5:
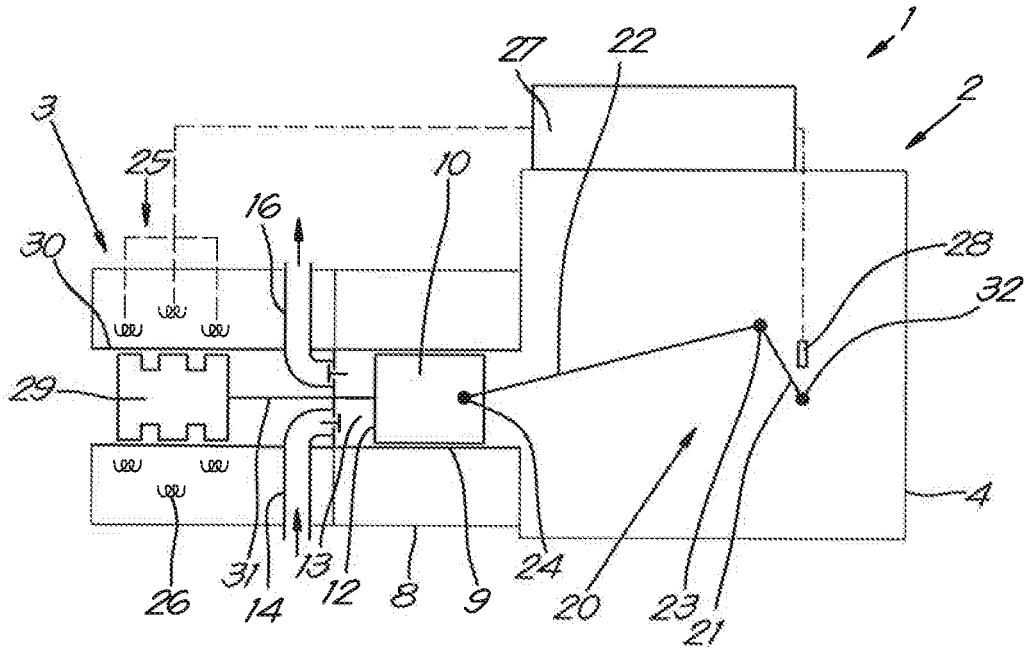
FIG. 5 show a variant embodiment of a piston compressor according to the invention.

FIG. 5 shows a variation of a piston compressor 1 according to the invention, in which in this case, the piston 10 is a traditional piston without coils 26 around the cylinder mantle 9, but in which the electromagnetic drive 25 of the piston 10 is realized by means of an external plunger 29 that is arranged movably back and forth in a linear guide 30, with one or more coils 26 arranged around it, capable of interacting inductively with the respective plunger 29 when reinforced in order to indirectly drive the piston 10 electromagnetically via a connection rod 31 that extends outward through the compression chamber 13 and the aforementioned end wall 11.

It is clear that a combination is also possible of a direct reinforcement of the piston 10 with an indirect reinforcement via an internal or external plunger 29.

It is furthermore possible to execute the piston 10 and one or several plungers 29 as a linear motor, more specifically as a linear step motor.

Figure 6:
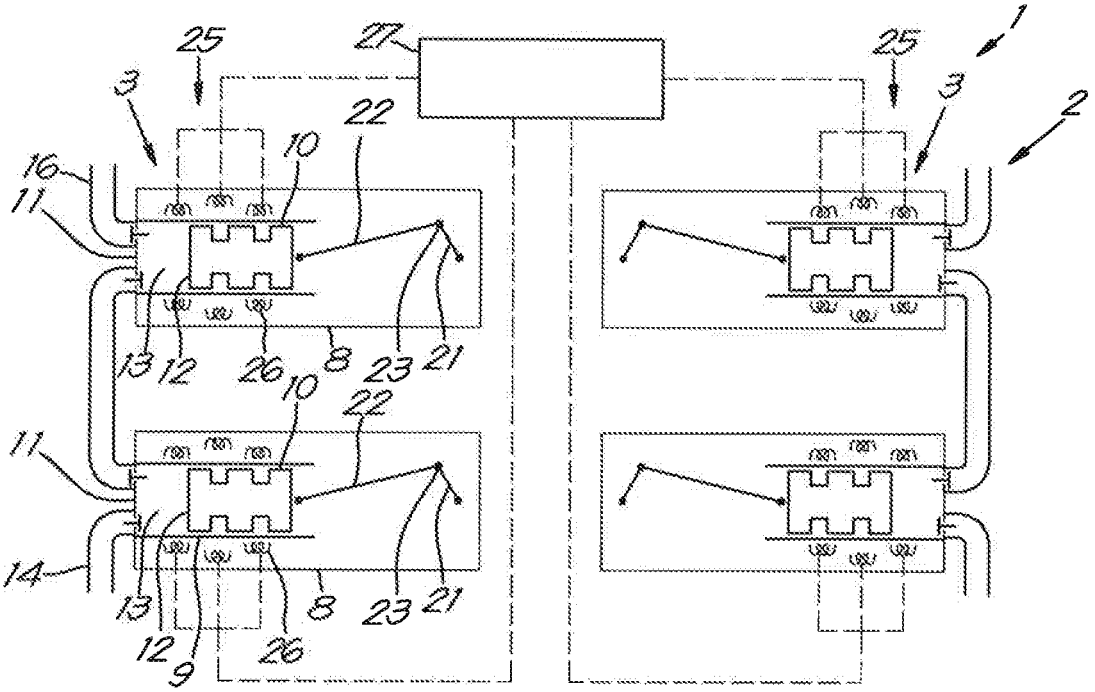
FIGS. 6 and 7 show two different variants of a multistage piston compressor according to the invention.

FIG. 6 shows a multistage piston compressor 1 with four stages, each having a piston 10 that is driven electromagnetically in a compression chamber 13 of its own, in which the compression chambers 13 are serially connected with each other by means of their inlet 14 and outlet 16.

In this case, each piston 10 is arranged together with its own kinematic mechanism 20 in a hermetically sealed housing 4-8 of its own.

The controls 27 are joint for the four pistons 10 in this case.

Figure 7:
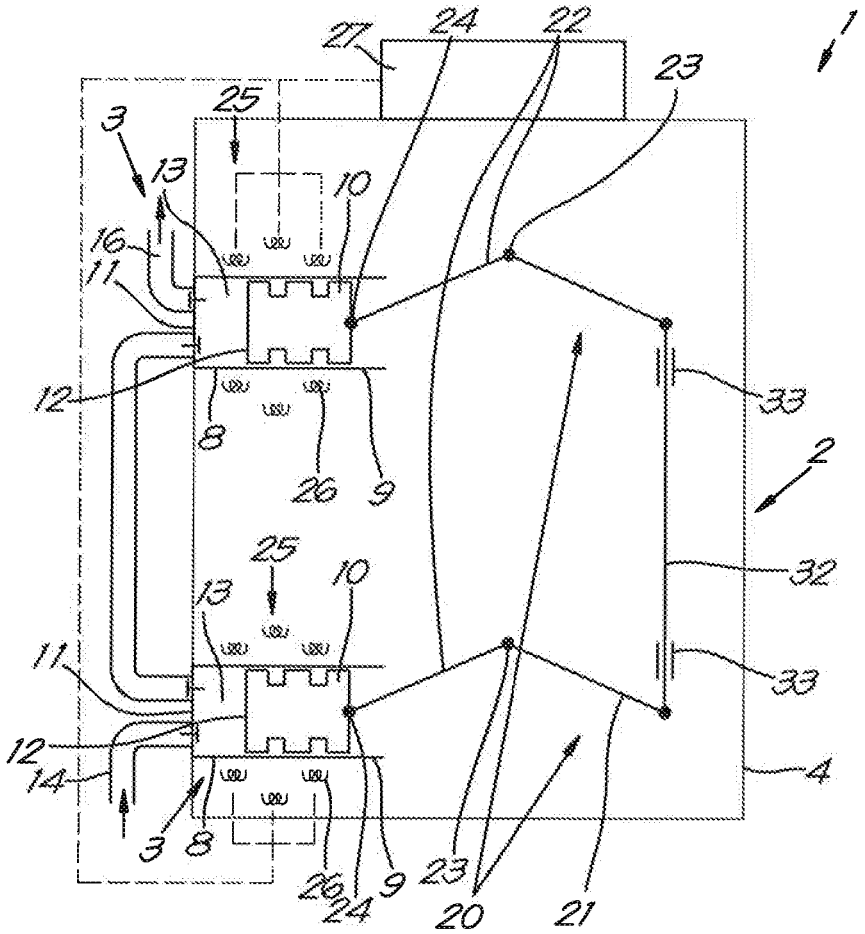

FIG. 7 shows a multistage piston compressor 1 with two stages, arranged in a joint hermetically closed housing 4-8, each having a piston 10 and a kinematic mechanism 20 of its own, but in which the two kinematic mechanisms 20 are mechanically connected with each other, in this case since the cranks 21 are arranged on a joint crank shaft 32 that is borne in the housings 4-8 on traditional ball bearings 33.

The present invention is in no way limited to the embodiments described above and shown in the figures. Rather, a piston compressor according to the invention may be realized in different variants without exceeding the framework of this invention.

The invention claimed is:

1. A piston compressor comprising a housing with a compression chamber in the housing, having an inlet and an outlet and a piston arranged to move back and forth within the compression chamber in an axial direction of the compression chamber between an upper dead point and a lower dead point, delimited by a kinematic mechanism with which the piston is connected, wherein a drive is formed exclusively by:

an electromagnetic linear drive of the piston, wherein the electromagnetic linear drive comprises a direct electromagnetic drive of the piston, or an indirect electromagnetic drive of the piston with a plunger connected to the piston by a connection rod and arranged movably back and forth in a linear guide that extends parallel to the axial direction of the compression chamber; and the kinematic mechanism is a crank and rod mechanism that includes:

a crank shaft perpendicular to an axial direction of a back and forth movement of the piston;

a radially focused crank that rotates with the crank shaft; and a driving rod that is pivotally attached on one end with the crank by a crank pin, and pivotally attached on an other end with the piston or the plunger, and wherein several coils are arranged in a direction parallel to a linear movement of the piston or plunger and capable of interacting inductively with the piston or the plunger, wherein at least one of the piston or the plunger comprises one or more magnets, wherein the one or more magnets are permanent magnets, wherein the electromagnetic linear drive comprises the several coils capable of interacting inductively with the piston or plunger, and wherein the piston compressor comprises controls for activating the electromagnetic drive during an entire compression stroke of the piston from the lower dead point to the upper dead point of the piston.

2. The piston compressor according to claim 1, wherein the plunger is arranged on the connection rod that is fixedly connected mechanically with the piston and moves back and forth synchronously with the linear movement of the piston.

3. The piston compressor according to claim 1, wherein the piston is connected with the crank by the driving rod, and the driving rod is a linear piston rod, connected to the piston and moving back and forth synchronously with the piston.

4. The piston compressor according to claim 1, wherein the housing contains no input or output shaft for driving the piston.

5. The piston compressor according to claim 1, wherein the crank shaft, the crank pin, and a piston pin are exclusively borne by means of closed roller bearings.

6. The piston compressor according to claim 1, wherein the housing of the piston compressor with the compression chamber with the piston and the kinematic mechanism in the housing is a hermetically sealed housing.

7. The piston compressor according to claim 1, wherein a frequency of the back and forth movement of the piston corresponds to a frequency of the piston compressor.

8. The piston compressor according to claim 1, wherein the piston compressor has a maximum compression capacity that is greater than 30 kW.

9. The piston compressor according to claim 1, wherein the electromagnetic linear drive comprises the indirect electromagnetic drive of the piston with the plunger arranged movably back and forth in the linear guide, which extends parallel to the axial direction of the compression chamber.

10. The piston compressor according to claim 1, wherein a number of the several coils is at least three, and the several coils are arranged in the direction parallel to the linear movement of the piston in order to subject the piston during a revolution of the crank to at least three electromagnetic forces.

11. The piston compressor according to claim 10, wherein force curves of the at least three electromagnetic forces overlap with each other in time.

12. The piston compressor according to claim 7, wherein the frequency of the piston compressor is a frequency of an entirety of the piston and of the kinematic mechanism combined with a pneumatic, mechanical, or electromechanical spring.

13. The piston compressor according to claim 1, wherein the electromagnetic linear drive comprises the direct electromagnetic drive of the piston with the several coils arranged around the compression chamber and capable of interacting inductively with the piston.

14. A multistage piston compressor comprised of: at least two piston compressors, each of the piston compressors comprised of the piston compressor according to claim 1, the respective inlet and outlet of each of the at least two piston compressors are serially connected with each other.

15. The piston compressor according to claim 14, wherein at least two of the respective piston compressor kinematic mechanisms are mechanically connected with each other, causing them to move synchronously with each other.

16. The piston compressor according to claim 15, wherein the respective cranks of at least two of the piston compressors are arranged on a joint crank shaft.

* * * * *